US005454319A

United States Patent [19]

Park et al.

[11] Patent Number: 5,454,319

[45] Date of Patent: Oct. 3, 1995

[54] PRINTING METHOD AND APPARATUS

[75] Inventors: Keun-yong Park; Moon-bae Park, both of Suwon, Rep. of Korea

[73] Assignee: Samsung Electronics Co., Ltd., Kyungki, Rep. of Korea

[21] Appl. No.: 314,380

[22] Filed: Sep. 28, 1994

[30] Foreign Application Priority Data

Sep. 28, 1993 [KR] Rep. of Korea ..... 93-20336
Sep. 29, 1993 [KR] Rep. of Korea ..... 93-20547

[51] Int. Cl.[6] ..... B41F 13/12

[52] U.S. Cl. ..... 400/485; 400/120.01; 400/634; 347/28

[58] Field of Search ..... 400/483, 485, 400/120.01, 120.02, 120.03, 120.04, 120.16, 120.17, 624, 625, 629, 632, 631, 633, 634, 636; 346/76 PH

[56] References Cited

U.S. PATENT DOCUMENTS 4,552,470 11/1985 Yana et al. ..... 400/120.02
4,594,597 6/1986 Liu et al. ..... 400/708
4,679,953 7/1987 Sone et al. ..... 400/708
5,001,498 3/1991 Shimizu et al. ..... 346/76 PH

*Primary Examiner*—Eugene H. Eickholt
*Attorney, Agent, or Firm*—Sughrue, Mion, Zinn, Macpeak & Seas

[57] ABSTRACT

A printing method and apparatus clamps a sheet of printing paper at a first position of a drum supplied with the printing paper. The printing paper is released from a clamped state at a second position just in front of an initial printing position. While unclamped, the leading edge of the printing paper is transferred to the initial printing position, so that printing is started from the leading edge and the printing paper is again clamped at a third position which is located beyond the initial printing position. Therefore, printing is performed from the leading edge of the printing paper, which results in printing without any margins. Also, a plate spring presses the printing paper toward the drum just in front of the printing position where the print head, applies pressure for printing. The plate spring elastically applies pressure to the printing paper to transfer the printing paper to the printing position while in contact with the drum.

11 Claims, 11 Drawing Sheets

PRINTING METHOD AND APPARATUS

BACKGROUND OF THE INVENTION

Field of the Invention

The present invention relates to a printing method and apparatus therefor, and in particular, to a printing method and apparatus in which a printing sheet is stably supplied to a printing position to print an original image without a blank space in the leading or trailing edge of the printing paper.

DESCRIPTION OF THE RELATED ART

A thermal printer, in which a ribbon doped with ink is located between a thermal print head and a printing paper to be printed, has a transfer structure for transferring ink sublimated with a predetermined pattern by the thermal print head onto the printing paper. In particular, a color type thermal printer performs printing three times by overlapping analytic images of yellow, magenta and cyan for the implementation of full coloring.

In FIG. 1, the major parts of a conventional thermal printer are schematically illustrated. Here, a printing paper cassette 6 is provided below a drum 2. A guide roller 3 is provided on the periphery of drum 2, for transferring printing paper 4 supplied from printing paper cassette 6 and guiding the printing paper while in contact with drum 2. In addition, a clamp 5 is provided on drum 2, for clamping the leading edge of printing paper 4 to clamp the printing paper to the periphery of drum 2. A thermal print head 1 having a heating element is provided above drum 2, and is movable up and down. An ink ribbon 7 is provided between thermal print head 1 and the printing paper, so that the ink is sublimated by the heat and pressure of thermal print head 1 in order to print an image onto printing paper 4.

The conventional thermal printer described above, first transfers a sheet of printing paper 4 from printing paper cassette 6 to drum 2, and the clamp 5 clamps the leading edge thereof. Subsequently, clamp 5 and drum 2 are rotated to transfer the leading edge of printing paper 4 to a position slightly beyond the portion directly under thermal print head 1, as shown in FIG. 1. This position is selected because, if clamp 5 clamping the leading edge of the printing paper 4 is located at an initial printing position (the portion directly under thermal print head), when thermal print head 1 moves down for printing, clamp 5 will interfere with printing. Then, thermal print head 1 moves down to apply pressure and heat to the ink ribbon to sublimate ink for printing an image.

However, in the thermal printer as described above, since clamp 5 transfers the leading edge of printing paper 4 to the position beyond the point directly under thermal print head 1, no image can be printed in the margin along the leading edge of the printing paper 4. Therefore, as shown in FIG. 2, a blank space exists along the boundaries of the printed image, and especially, on the leading edge of the printing paper. This creates a poor appearance and wastes paper. Here, the left and right blank spaces shown in FIG. 2 can be eliminated by adjusting the size of thermal print head 1, but the leading edge blank space still remains. Therefore, for a more symmetrical appearance, the left, right and trailing edge blank spaces should be provided.

In addition, printing is performed while thermal print head 1 applies a predetermined pressure (usually, 5 kg/cm$^2$) to ink ribbon 7 and the printing paper 4 and drum 2 is rotated. The printing paper 4 is transferred to the initial printing position by the rotational force of drum 2. However, the portion of printing paper 4 located adjacent to the printing position tends to become separated from drum 2 thus reducing image quality.

A thermal printer is disclosed in U.S. Pat. No. 5,001,498, wherein the leading edge of a sheet of printing paper is transferred to a top point of a roller and then printing is performed, so that printing is performed from the leading edge to the trailing edge of the printing paper. In such a device, printing is accomplished without blank spaces, but the printing paper must be transferred to the top point for printing while being pressed by a roller. Accordingly, such a device is complex.

SUMMARY OF THE INVENTION

An object of the present invention is to provide a printing method and a printing apparatus therefor, in which an image of an original source can be printed on the leading and trailing edges of a sheet of printing paper.

Another object of the present invention is to provide a printing apparatus for stably supplying a sheet of printing paper to a printing position to produce a high quality printed image.

To attain this object, there is provided a printing method according to one embodiment of the present invention, in which printing paper is supplied to a rotating drum and transferred while being clamped to the rotating drum and is printed by a printed head. The clamp is controlled such that, the printing paper is clamped at a first position of the drum and released at a second position just in front of an initial printing position, and the leading edge of the printing paper is transferred to the initial printing position so that printing starts at the leading edge of the printing paper. The printing paper is again clamped at a third position located beyond the initial printing position. A printing method according to another embodiment of the present invention, includes pressing the printing paper at the position just in front of the initial recording position when the print head is moved down in order to apply pressure to the leading edge of the printing paper.

A printing apparatus according to the invention has a rotating drum to which a printing paper is supplied and a clamp for clamping the printing paper and rotating with the drum. A print head prints an image on the printing paper. A clamp control device controls the clamp such that the printing paper is clamped at a first position of the drum and released at a second position just in front of an initial printing position, and the leading edge of the printing paper is transferred to the initial printing position so that printing starts at the leading edge of the printing paper. The clamp control device cause the printing paper to be again clamped at a third position located beyond the initial printing position.

Also, the invention includes a printing paper guiding device for pressing the printing paper to the drum just in front of the initial printing position, when the print head is moved down in order to apply pressure to the leading edge of the printing paper.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 3:
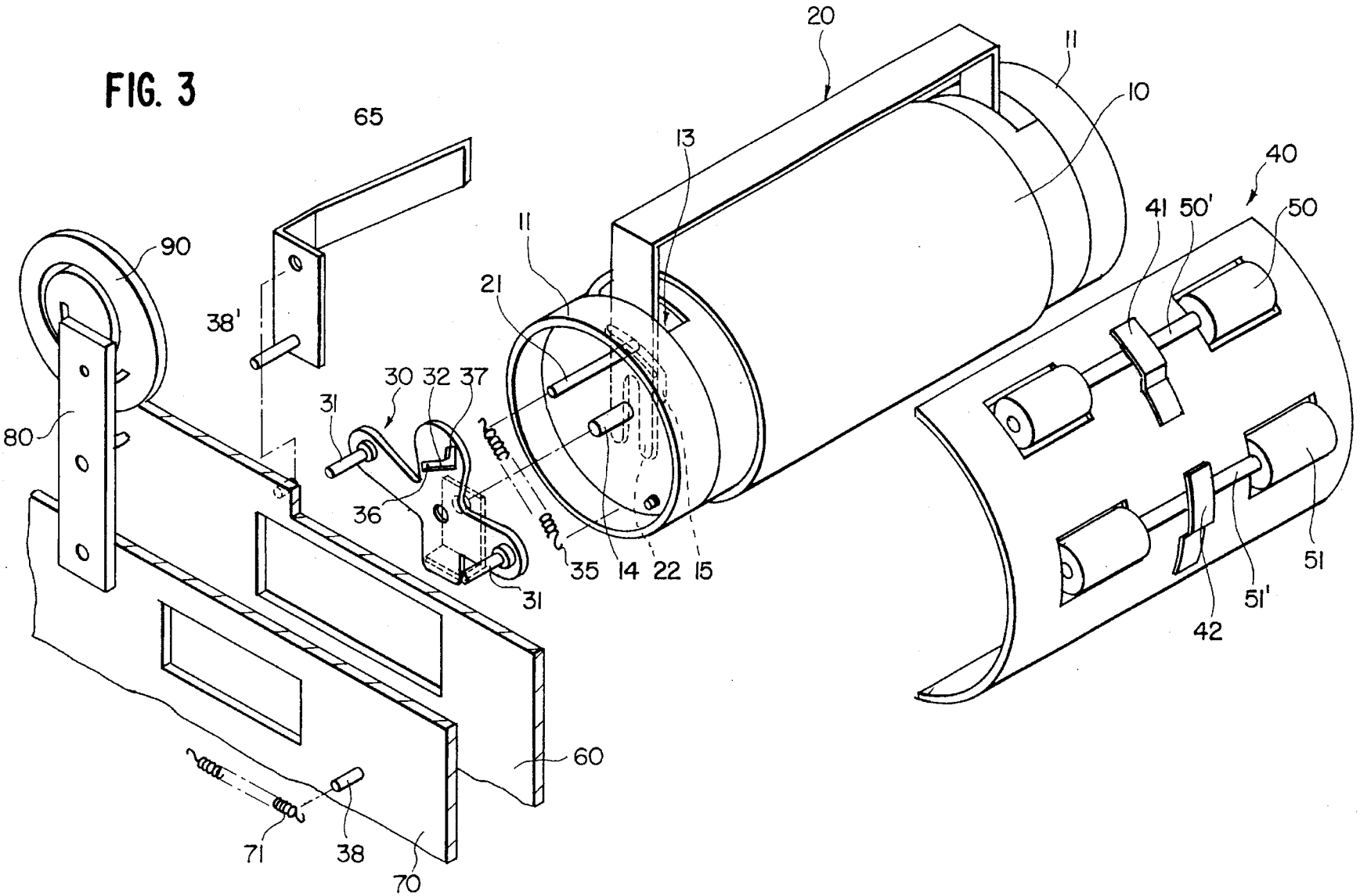
FIG. 3 is an exploded perspective view illustrating one embodiment of the printing apparatus according to the present invention.
Figure 4:
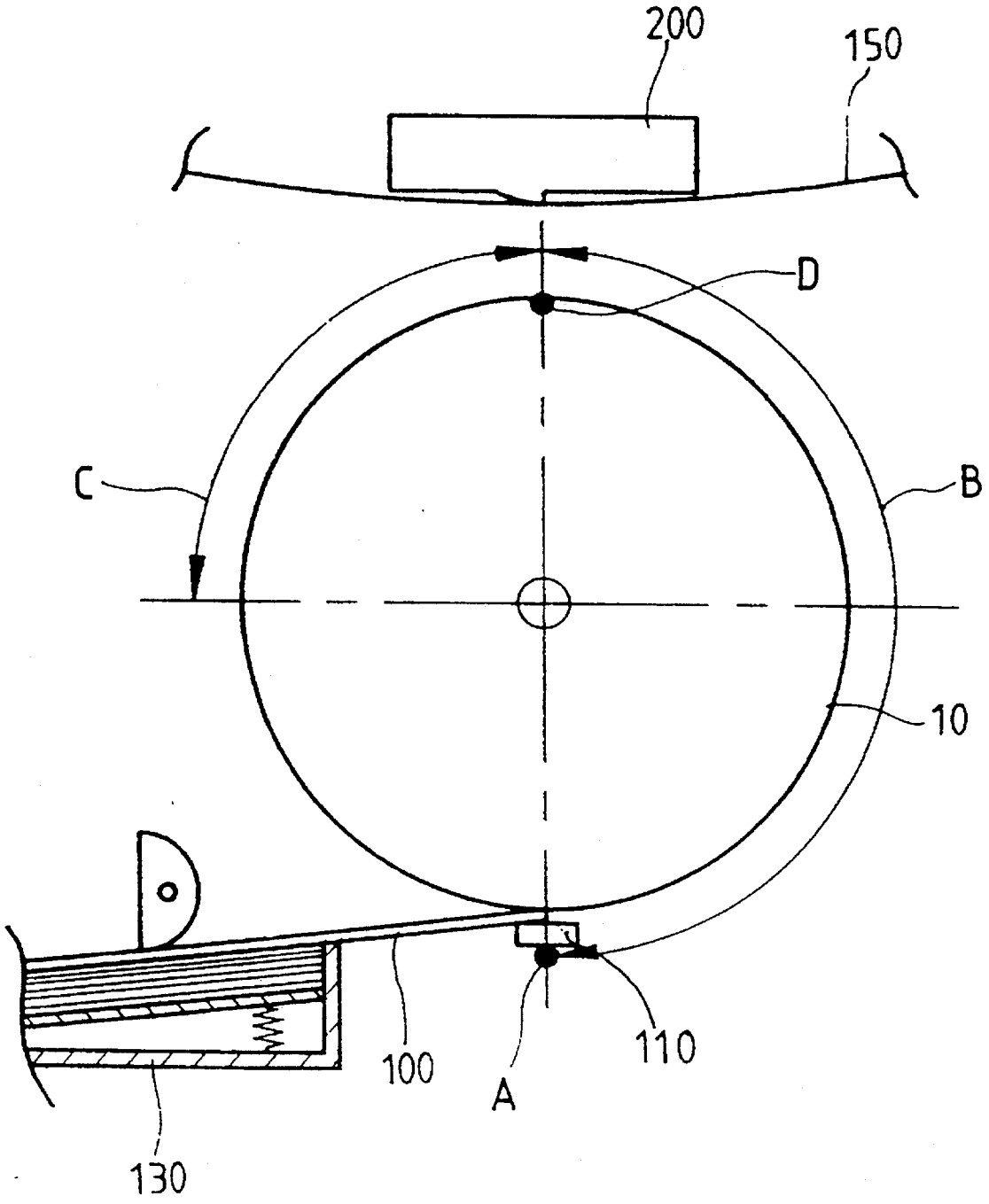
FIG. 4 is a schematic view for explaining the operation of the printing apparatus shown in FIG. 3.

Referring to FIGS. 3 and 4, which illustrate a first preferred embodiment, a drum 10 which rotates in accordance with a driving signal from a drive source (not shown) is mounted in rotatable fashion on a frame 60 (one side of which is not shown). A clamp 20, which clamps the leading edge of the printing paper 100 and transfers the printing paper 100 while in contact with drum 10, is coupled to drum 10 such that the clamp 20 can be slid with respect to the drum 10. In addition, a sensor 110 for sensing the initial paper supplying state of the printing paper is provided proximate the lower part of drum 10.

The sensor 110 senses the printing paper 100 and outputs a signal to a drive source (not shown) for driving drum 10, so that drum 10 is rotated through predetermined steps. Also, proximate the upper part of drum 10, a thermal print head 200, which generates heat in a pattern determined in accordance with a printing signal (in a known manner), is supported by a predetermined elevating element (not shown). The thermal print head 200 can also be moved up and down with respect to the drum 10. An ink ribbon 150 is provided between the print head 200 and drum 10. Guide rollers 50 and 51 are provided on a supporting element 40, their axes being elastically supported by plate springs 41 and 42, guide and transfer the printing paper 100 while the printing paper 100 is in contact with drum 10.

The printing method according to one embodiment of the present invention will now be explained.

Referring to FIGS. 3 and 4, the printing paper 100 is clamped at a first position A of drum 10 where printing paper 100 is supplied and is unclamped at a second position B just in front of the initial printing position D. Thus, the leading edge of the printing paper 100 is located at the initial printing position D in an unclamped state and printing is initialized on the leading edge. Clamp 20 is controlled by a controller such that, when the printing paper 100 passes over the initial printing position D, re-clamping is performed at a third position C for transferring the printing paper 100.

In more detail, the printing paper 200 is supplied from supplying cassette 130 to drum 10 in accordance with a paper supplying signal. If the leading edge of the printing paper 100 is detected by sensor 110, the leading edge of the printing paper 100 is clamped by clamp 20, and simultaneously the sensing signal is transferred to a drive source (not shown) so that drum 10 is rotated.

At this time, the printing paper 100 is transferred by being rotated along with drum 10, with its leading edge clamped by clamp 20. Also, the leading edge of the printing paper 100 is unclamped at second position B and simultaneously the clamp 20 is transferred to the third position C by rotating about axis 14 faster than drum 10. On the other hand, the printing paper 100 whose leading edge is positioned at the second position B, is transferred by the rotation of drum 10. At this time, drum 10 rotates in accordance with the signal of the printing paper sensor 110, so that the leading edge is placed at the initial printing position D, and then drum 10 stops rotating.

Then, an image of a one of yellow, magenta or cyan is converted to a printing signal in a known manner and is input to print head 200. Next, print head 200 moves down to apply pressure and heat loaded on the printing signal to ink ribbon 150 to sublimate ink in ink ribbon 150 with a predetermined pattern, so as to print an image onto the printing paper 100 in a known manner.

After an image is printed on the leading edge, the clamp 20 located at the third position C re-clamps the leading edge of the printing paper 100, to thereby transfer the printing paper 100. After one color is printed onto the printing paper 100 as described above, the other colors are printed in sequence, to complete the printing of the original image. Then, the printing paper 100 is ejected through an ejecting roller 120 (see FIG. 6).

In this method, when the unclamping of the printing paper 100 is performed at the second position B, the printing paper 100 is stably guided for transferring to the initial printing position D. Guide rollers 50 and 51 are elastically supported at the second position B by drum 10, so that the unclamped printing paper 100 is stably transferred between drum 10 and guide rollers 50 and 51. As described above, the printing method according to the present invention enables the original image to be printed in the leading edge margin of the printing paper 100.

The printing apparatus according to the first preferred embodiment of the present invention has the following structure.

First, referring to FIG. 4, clamping is performed at the first position A where the printing paper is supplied and unclamping is performed at the second position B which is just in front (i.e., upstream) of the initial printing position D of drum 10 so that the leading edge of the printing paper 100 is moved to the initial printing position D in an unclamped state and then printing begins at the leading edge. The apparatus includes a clamp controller which controls the clamping action such that, re-clamping is performed at the third position C beyond the initial printing position D.

Figure 1:
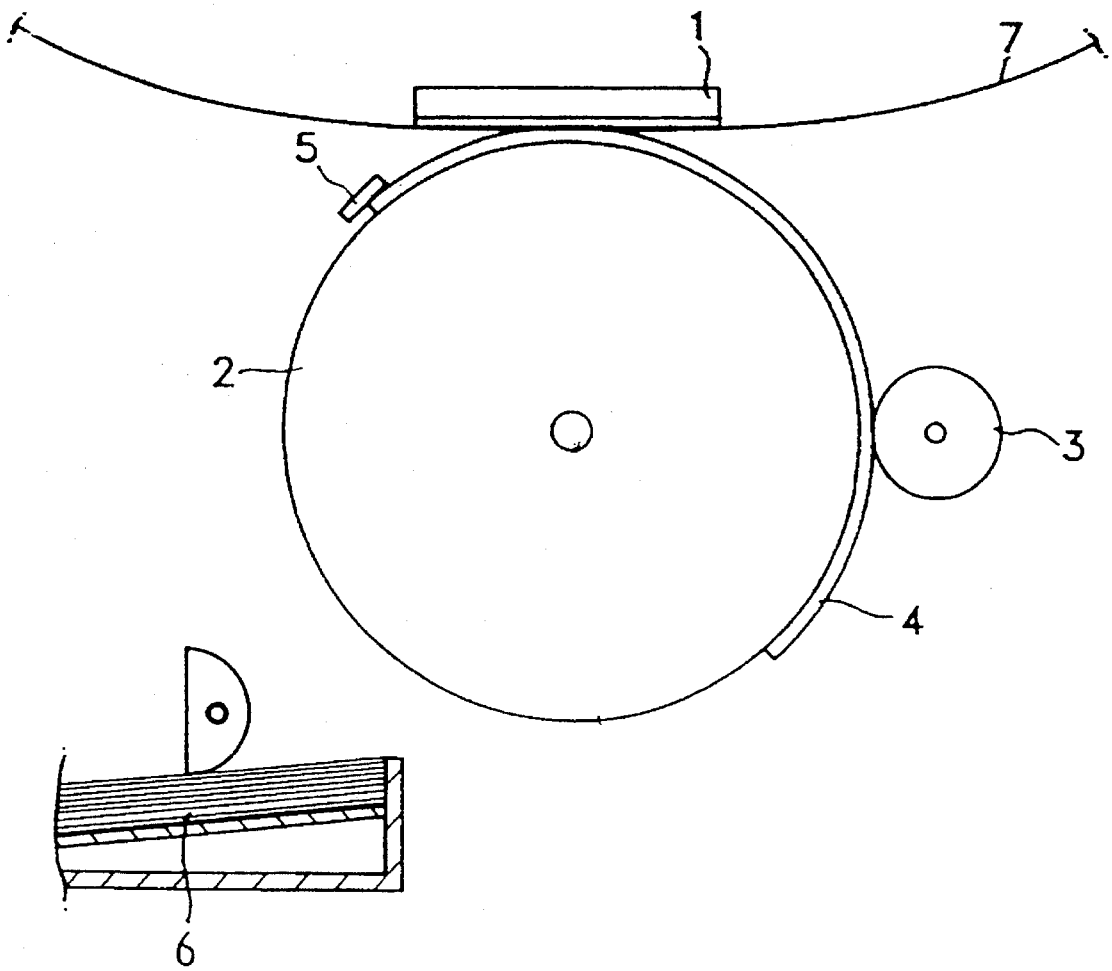
FIG. 1 is a schematic view illustrating a conventional thermal printer.
Figure 2:
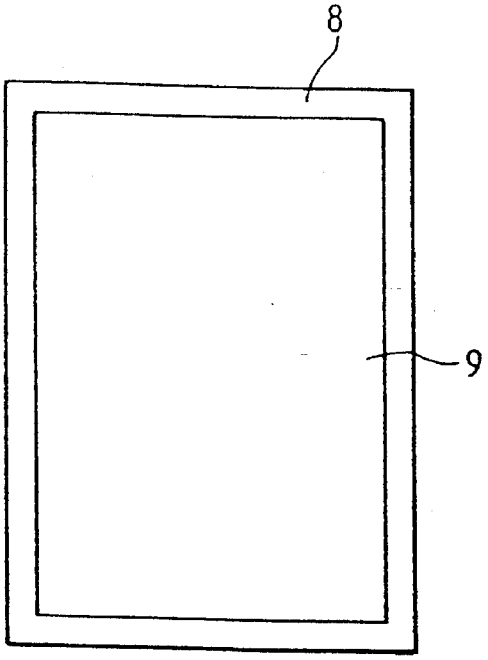
FIG. 2 is a plan view illustrating the state of a printed image, using the printer shown in FIG. 1.
Figure 5:
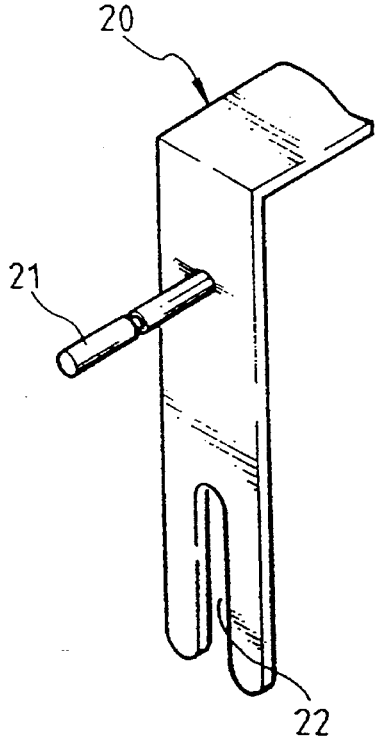
FIG. 5 is a perspective view illustrating the major parts of the clamp shown in FIG. 3.
Figure 10:
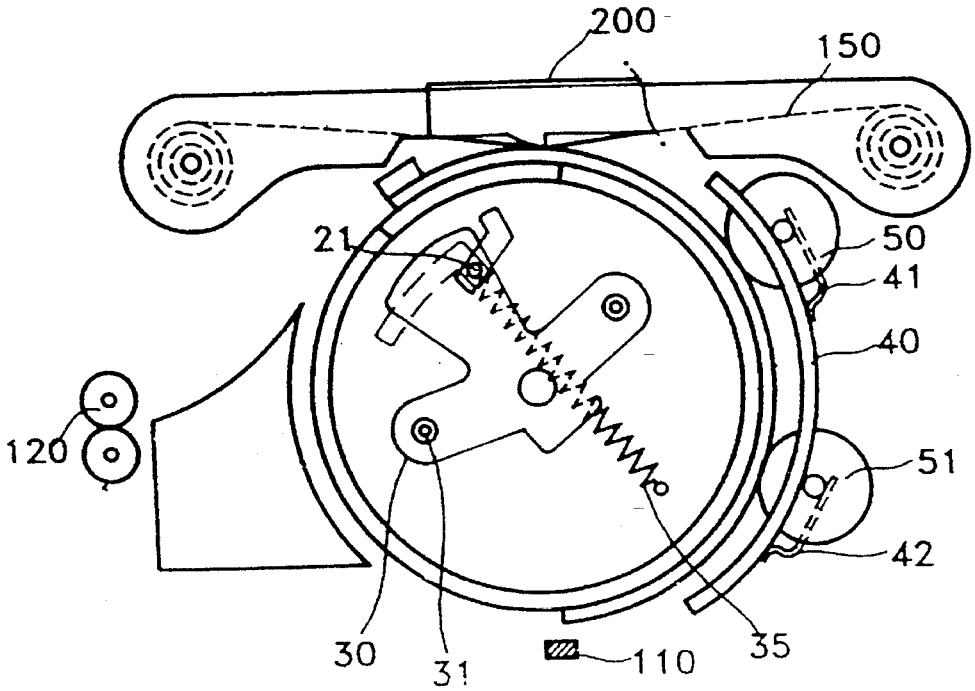
FIGS. 6–10 are views for explaining the operation of the printing apparatus according to the embodiment of FIG. 3.

Referring to FIG. 3, (in FIG. 3 only one side of the printer is illustrated and the other side is similar to the illustrated side) axis 14 of drum 10 is supported in a frame 60 for rotation, and clamp 20 is coupled to axis 14 such that its rotation is also enabled. Slots 22 are formed in both ends of clamp 20, to enable clamp 20 to slide toward and away from drum 10. Gearing pins 21 are respectively projected from both sides of clamp 20. The slots 22 and gearing pins 21 are shown in detail in FIG. 5.

In addition, openings 13, which define the rotation angle of the clamp 20 with respect to drum 10, are formed in both sides of drum 10. Flanges 11 having a first cam hole 15 coupled to the gearing pin 21 are attached to both sides of drum 10 in which the opening 13 is formed. A lift 30, in which a second cam hole 32 is formed, is coupled to the axis of drum 14. The gearing pin 21 passes through the first cam hole 15 and the second cam hole 32. A horizontal groove unit 36 is coupled to a vertical groove unit 37 in the second cam hole 32. On one side of drum 10, there is provided an operating element for operating the lift 30 such that the gearing pin 21 slides in the first and second cam holes 15 and 32.

In the clamp control element having the structure described above, the lift 30 rotates in accordance with the operation of the operating element and the gearing pin 21 is guided through the first and second cam holes 15 and 32 in accordance with the rotation of the lift 30, and simultaneously the clamp 20 clamps the printing paper 100 at the second position B. The gearing pin 21 is connected to the lift 30 so that clamp 20 moves to the third position C while in an unclamped state.

The operating element includes a slider 70 which is slidable with respect to frame 60 supporting drum 10, a linkage lever 80 pivotally mounted on frame 60 and having one end connected to slider 70 by the other end coupled to cam 90 to operate slider 70, and an operating lever 65 pivotally mounted on frame 60 and having one end connected to slider 70 via a spring 71. In this constitution, the lift 30 is rotated in accordance with the left and right movement of slider 70. Here, a pin 31 is formed on lift 30, so that when operating lever 65 is rotated in clockwise direction, operating lever 65 contracts the pin 31 to cause lift 30 to be also rotated.

In addition, proximate the first position A guide rollers 50 and 51 are formed, and are elastically biased toward drum 10, so that when the clamping state of the printing paper 100 is released at the second position B, the printing paper 100 is transferred between drum 10 and guide rollers 50 and 51. Supporting element 40 has the same curvature as that of drum 10 and is thus positioned apart from drum 10 at a predetermined distance. Guide rollers 50 and 51 are in contact with drum 10. The axes of guide rollers 50 and 51 are supported by means of plate springs 41 and 42 formed on the supporting element 40.

Also, the linkage pin 21 is connected to the flange 11 by a spring 35, so that when the clamp 20 is returned from the releasing state to the clamping state, the returning action is performed elastically.

As discussed above, a sensor 110 is provided proximate the first position on one side of drum 10. The sensor 110 senses the leading edge of the printing paper supplied to drum 10 and generates a sensing signal to a drive motor (not shown) which drives drum 10, so the drum begins to rotate and the leading edge of the printing paper 100 is transferred to the initial printing position.

The operation of the printing apparatus described according to the first embodiment of the present invention, is described in detail below.

Figure 6:
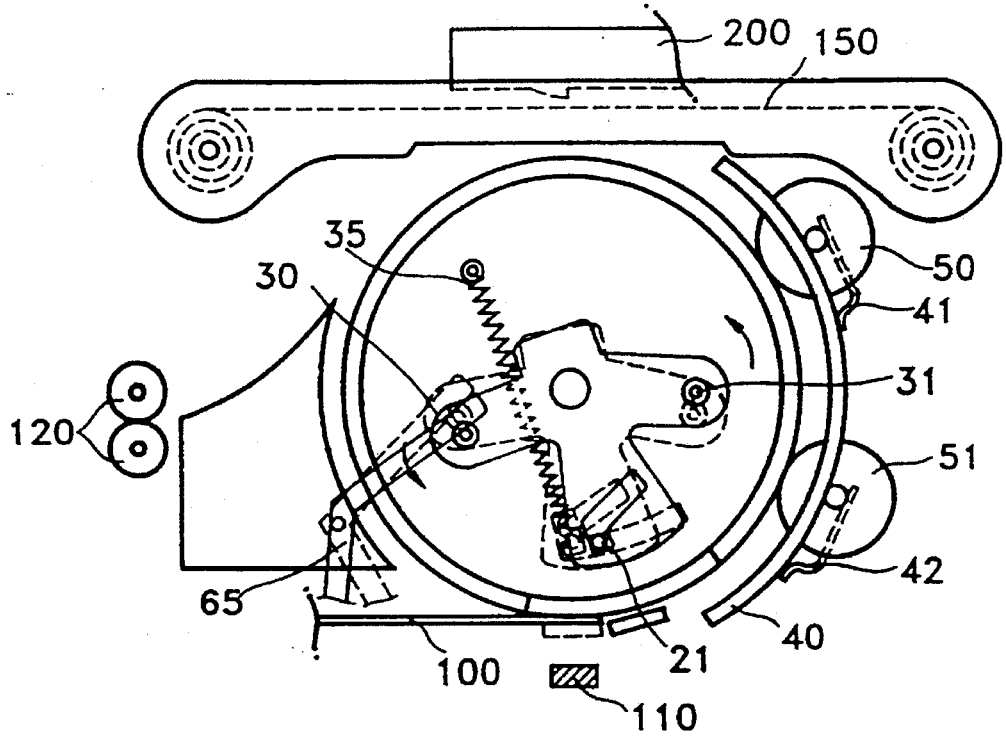

Referring to FIGS. 3–10, if a sheet of printing paper 100 is supplied from the paper supplying cassette (not shown) to drum 10, the leading edge of the printing paper 100 is sensed by sensor 110. At this time, the sensing signal of sensor 110 is fed to a drive motor (not shown) which rotates cam 90 in an appropriate direction. Accordingly, linkage lever 80 is rotated in a counterclockwise direction in order to move the slider 70 to the left. As the slider 70 is thus moved, operating lever 65 connected with slider 70 by means of spring 71 is rotated clockwise so as to come into contact with the pin 31 of lift 30. One end of spring 71 is coupled to a pin 38 projecting from slider 70, and the other end thereof is coupled to a pin 38' projecting from operating lever 65 through frame 60 and slider 70. At this time, as shown in FIG. 6, the lift 30 contacts pin 31 by rotating counterclockwise. In addition, lift 30 moves linkage pin 21 by rotating counterclockwise.

At this time, clamp 20 is rotated in the counterclockwise direction, to thereby become unclamped, and the printing paper 100 is inserted between drum 10 and clamp 20. With the printing paper 100 thus inserted, slider 70 is moved to the right by the clockwise rotation of cam 90, so that operating lever 65 is rotated counterclockwise and lift 30 is rotated clockwise. By this clockwise rotation of lift 30, the lift moves linkage pin 21 of clamp 20 and clamp 20 is rotated clockwise to a predetermined angle, to thereby clamp printing paper 100.

Figure 7:
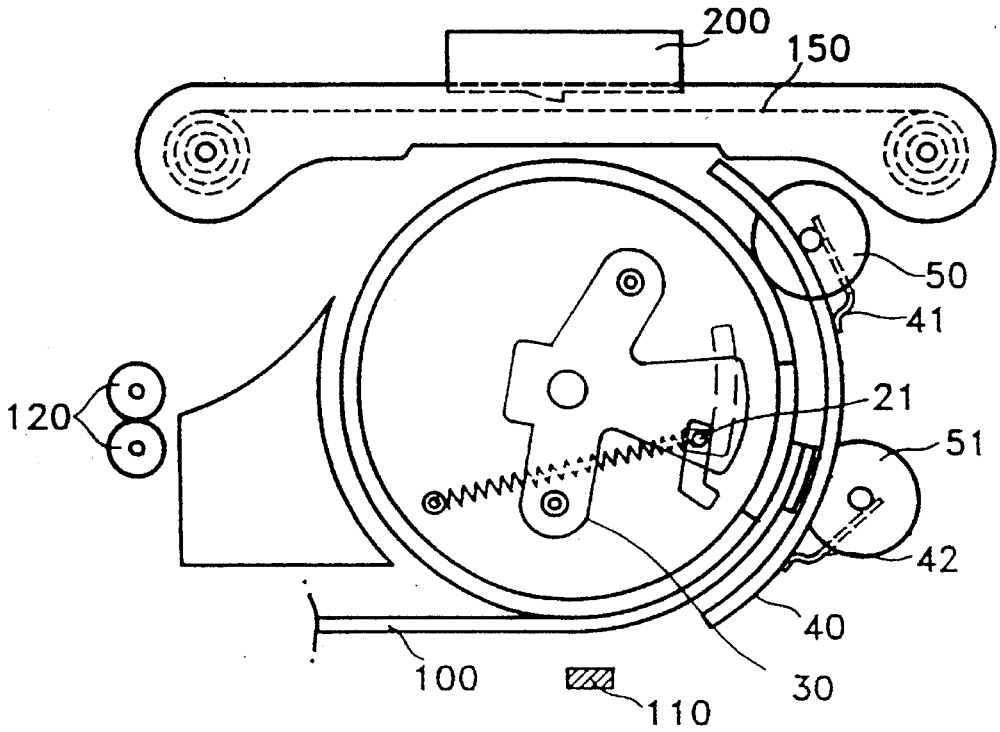
Figure 8:
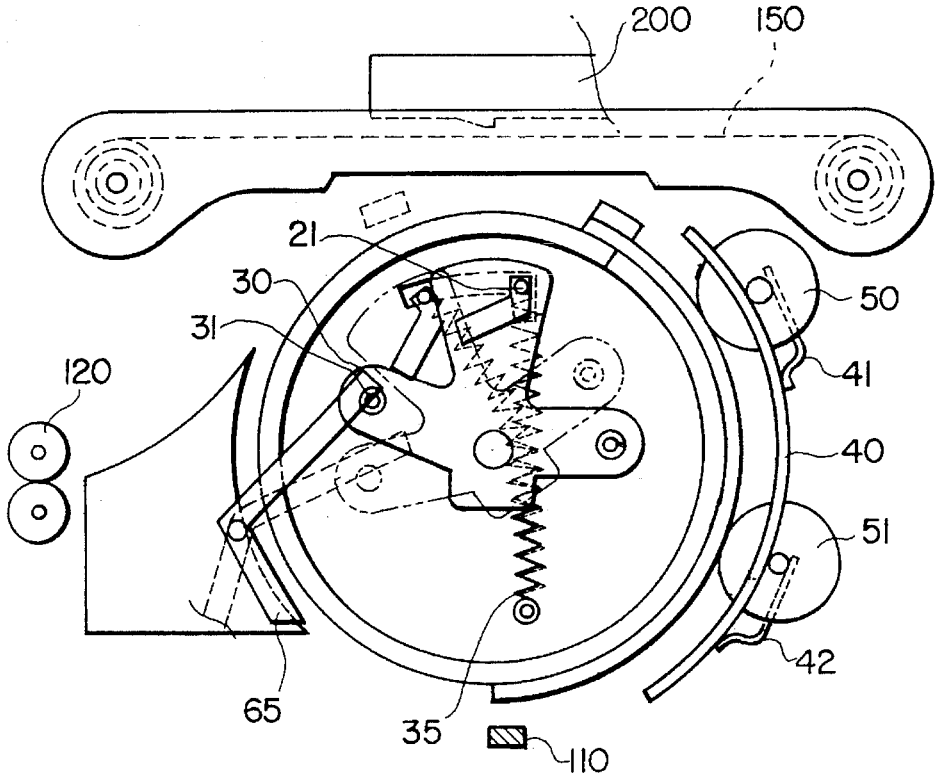

With the leading edge of the printing paper 100 clamped, the signal of sensor 110 is fed to a motor (not shown) which drives drum 10, so as to rotate drum 10 such that the leading edge of the printing paper 100 is placed at the initial printing position D (FIG. 4) which is opposite print head 200. When the leading edge approaches second position B while the leading edge of the printing paper 100 is clamped by drum 10 and clamp 20, clamp 20, as shown in FIG. 7, is moved while elastically pushing guide roller 50 and 51. Immediately after clamp 20 passes guide roller 50, slider 70 is moved to the left counterclockwise rotation of cam 90, so operating lever 65 is rotated clockwise and pin 31 of lift 30 is rotated counterclockwise due to the contact with operating lever 65, as shown in FIG. 8. At this time, in accordance with the rotation of lift 30, linkage pin 21 of clamp 20 is moved along first and second cam holes 15 and 32, so the clamping is released and clamp 20 is rotated to a predetermined angle in the counterclokwise direction (to the third position C, referring to FIG. 4). Here, the rotation angle of clamp 20 is determined in accordance with the size of the opening 13 formed in drum 10 and a stable state of spring 35 is maintained by operating lever 65. On the other hand, the printing paper 100 which is unclamped just after it passes under guide roller 50 is moved according to the signal of sensor 110 until its leading edge is placed at the printing position D. Here, the printing paper 100 is moved due to the frictional force itself and drum 10.

Figure 9:
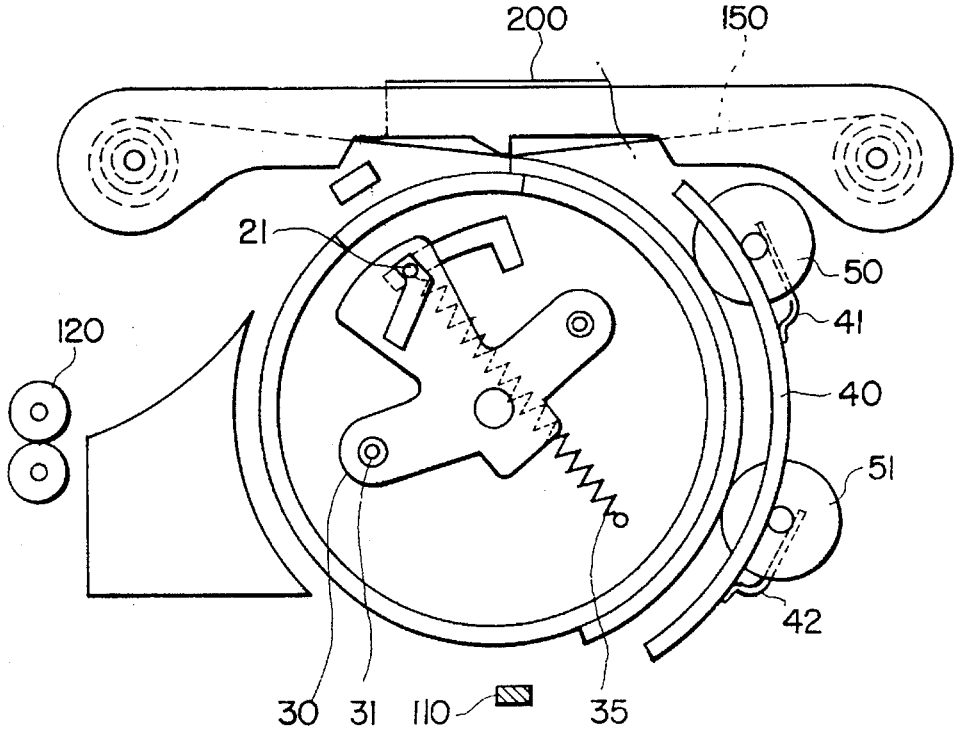

In accordance with the signal of sensor 110, drum 10 is driven, so the leading edge of the printing paper 100 is moved to the initial printing position D (FIG. 4). In this condition, the rotation of drum 10 is stopped and, as shown in FIG. 9, ink ribbon 150 is wound in accordance with a printing signal so that the leading edge of the yellow, magenta or cyan component is placed at the initial printing position of the print head 200, and print head 200 is moved down by a driving element (not shown) to apply pressure to the leading edge of the printing paper 100.

In this state, print head 200 applies pressure and heat to ink ribbon 150 in accordance with the printing signal, to perform printing from the leading edge of the printing paper 100. Printing is made by counterclockwise rotation of drum 10, and the leading edge of the printing paper 100 is again clamped at the third position C after an image has been printed thereon. At this time, clamp 20 clamps the leading edge of the printing paper 100 while its linkage pin 21 is moved along first and second cam holes 15 and 32 due to the restoration force of spring 35.

At this time, the printing paper 100 can be stably transferred while in contact with drum 10 by clamp 20 clamping the leading edge thereof. If the leading edge of the printing paper 100 is again placed at the position of sensor 110, the same operation as that described above is repeatedly performed in accordance with the signal detecting the leading edge, to print the other colors. Accordingly, after all colors are printed by the repetitive rotation of drum 10, the printing paper 100 is ejected by an ejecting roller 120.

The printing can be performed up to the trailing edge of the printing paper 100. For stable printing on the printing paper 100, a separate guide roller having the same structure as that of the guide rollers 50 and 51 can be placed at the third position C.

Now, a printing method and apparatus according to another embodiment of the present invention will be explained.

Figure 11:
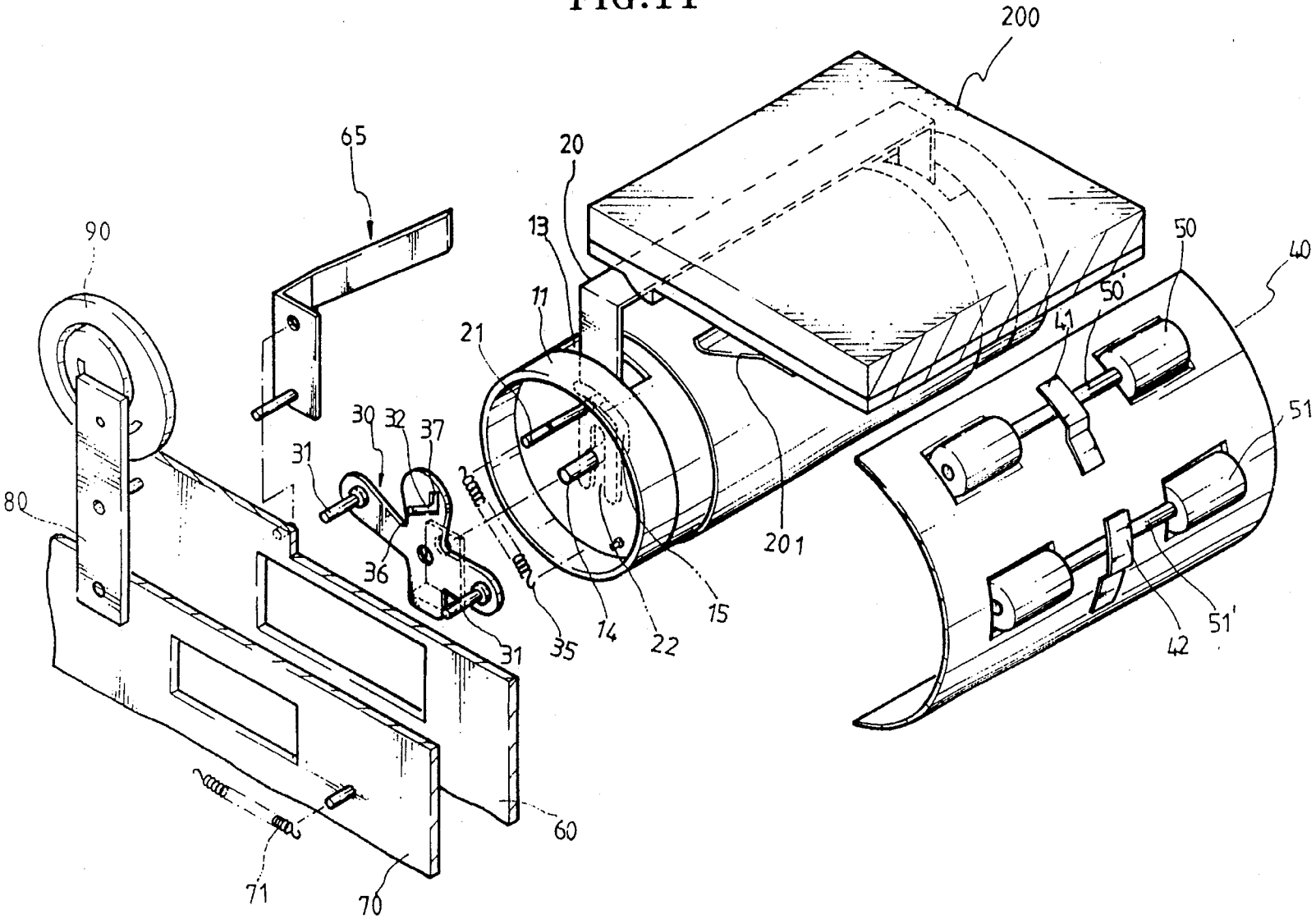
FIG. 11 is an exploded perspective view illustrating another embodiment of the printing apparatus according to the present invention.

FIG. 11 is an exploded perspective view illustrating a printing apparatus according to another embodiment of the present invention. Here, like elements are identified with the same reference numerals as in FIG. 3, and thus their operation will not be explained in detail.

Comparing this embodiment of the present invention with that of FIG. 3, the only difference is that this embodiment further includes a printing paper guide element which presses the printing paper 100 to drum 10 just in front of the initial printing position D where print head 200 performs printing by applying pressure. The printing method corresponding to this apparatus differs from that of FIG.3 in that it further includes a printing paper guiding step.

In addition, with regard to the printing paper guide element, plate spring 201 is placed on print head 200 so that print head 200 applies pressure to the printing paper 200 and plate spring 201 simultaneously applies pressure to the printing paper at a point just previous (i.e. upstream) of the former pressing position.

Next, the operation of the second embodiment of the present invention will be explained. Here, the operation of FIGS. 14, 15, 17 and 18 is similar to those of FIGS. 6, 7, 9 and 10, respectively.

Figure 12:
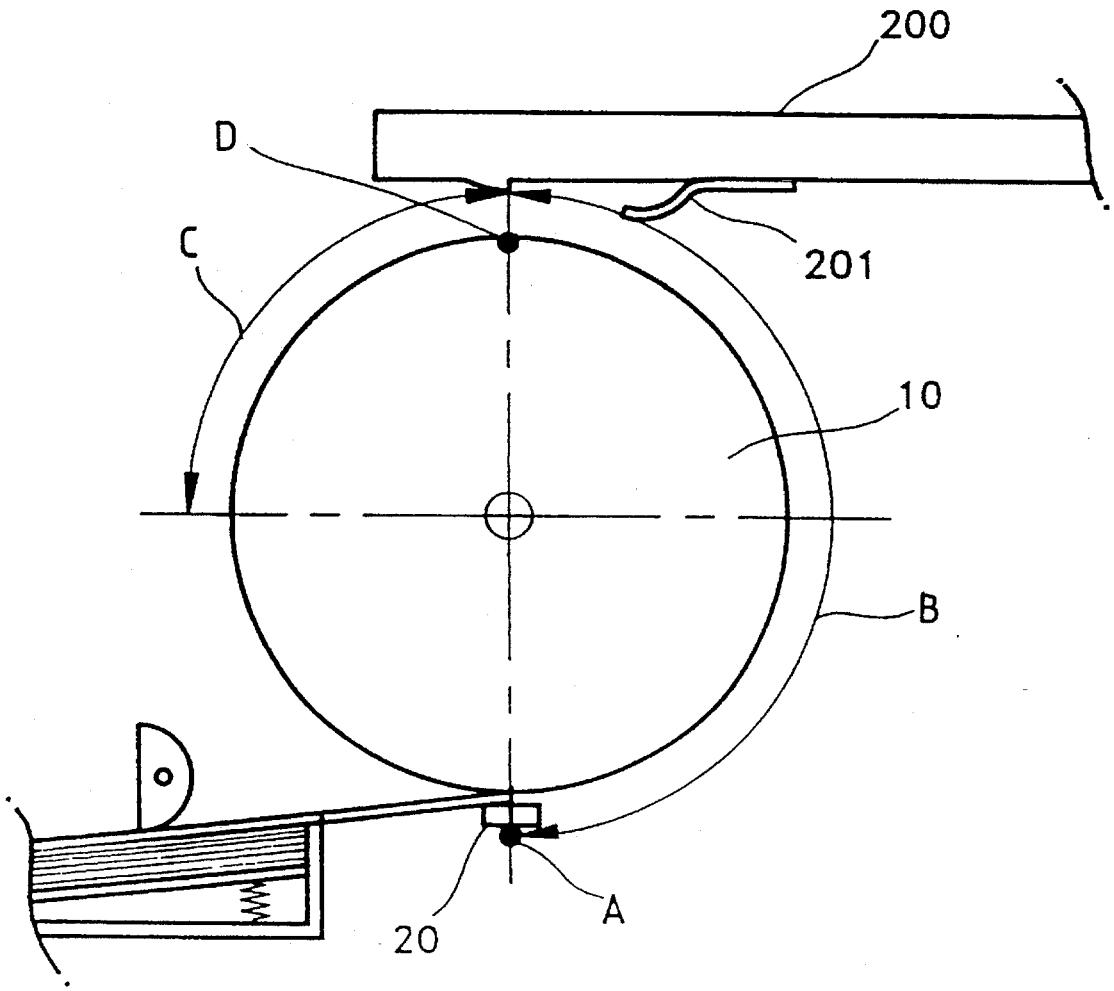
FIG. 12 is a schematic view for explaining the operation of the printing apparatus shown in FIG. 11.
Figure 13:
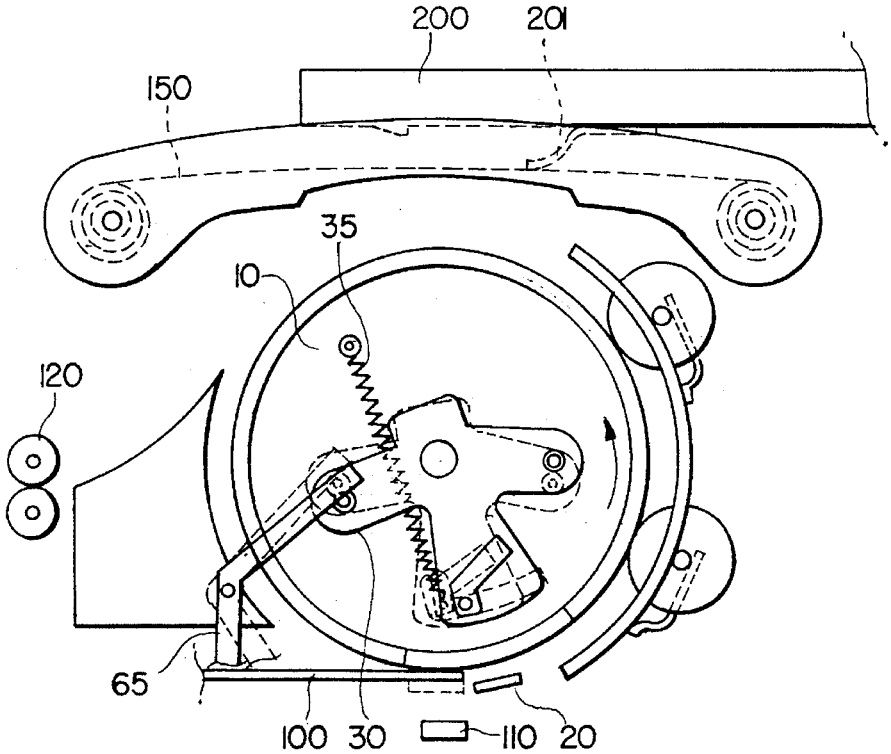
FIGS. 13–18 are views for explaining the operation of the printing apparatus according to the embodiment FIG. 11.
Figure 14:
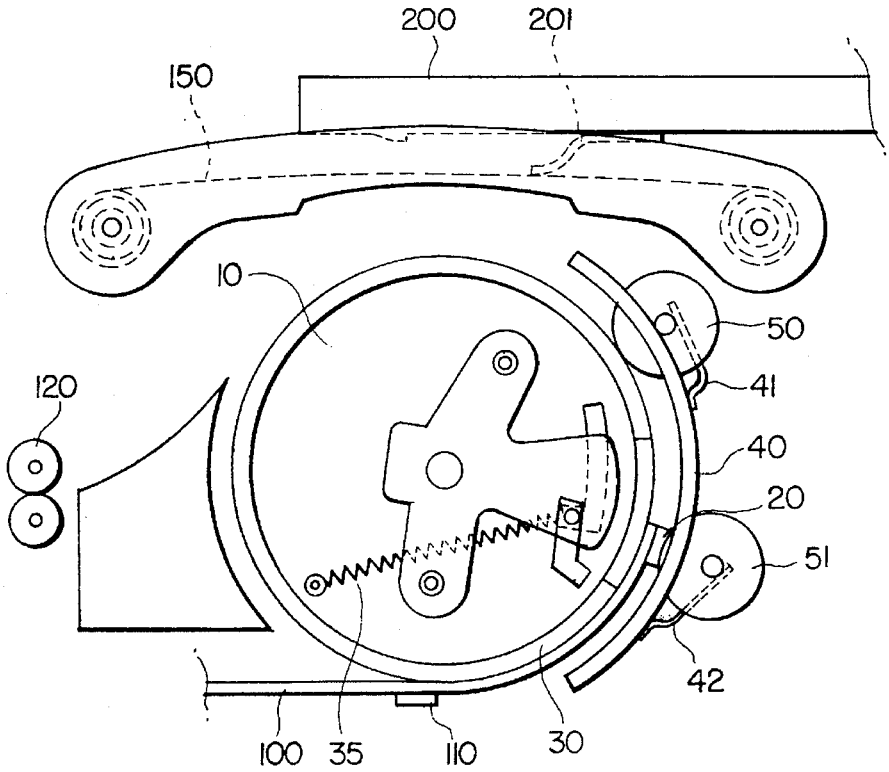
Figure 15:
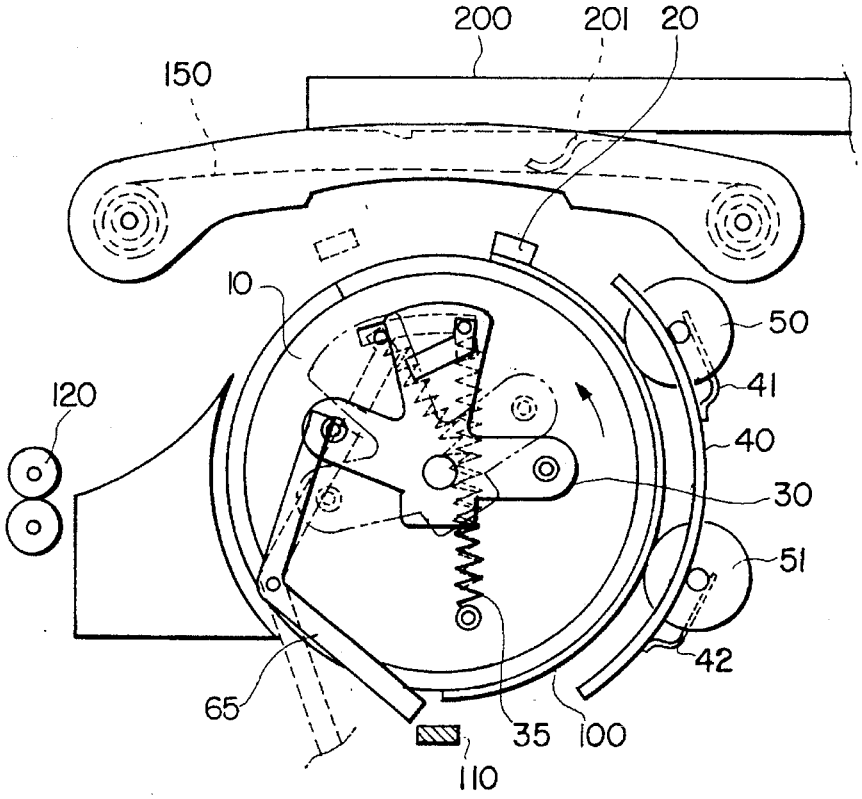
Figure 16:
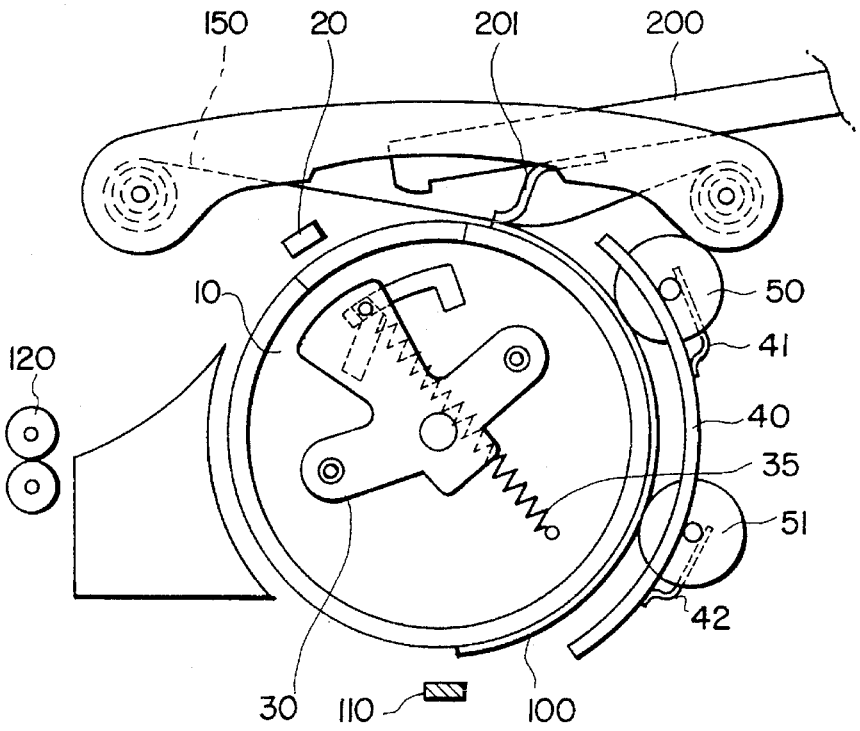
Figure 17:
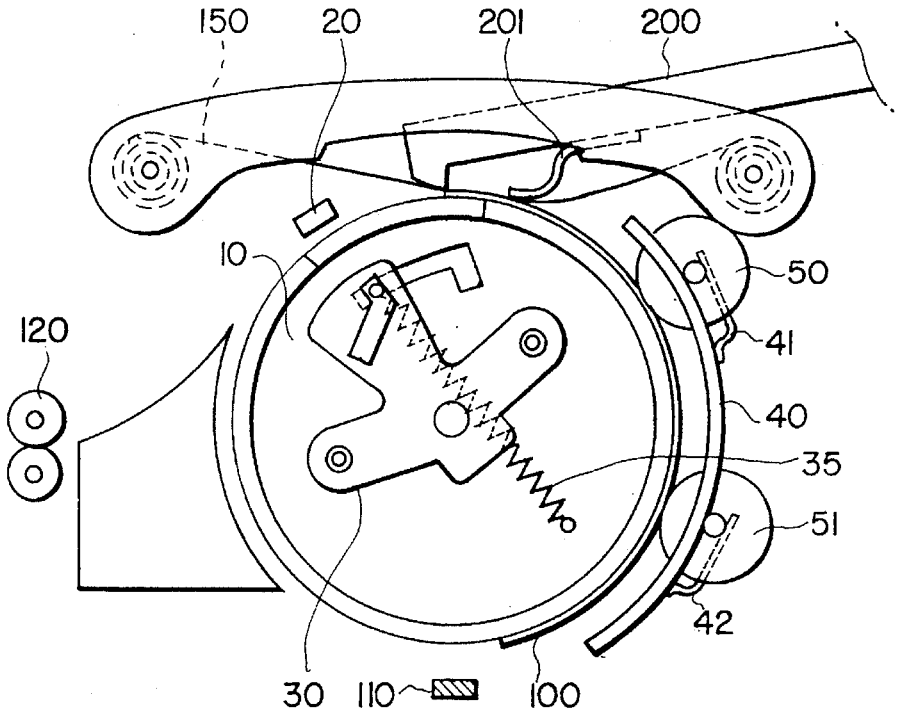
Figure 18:
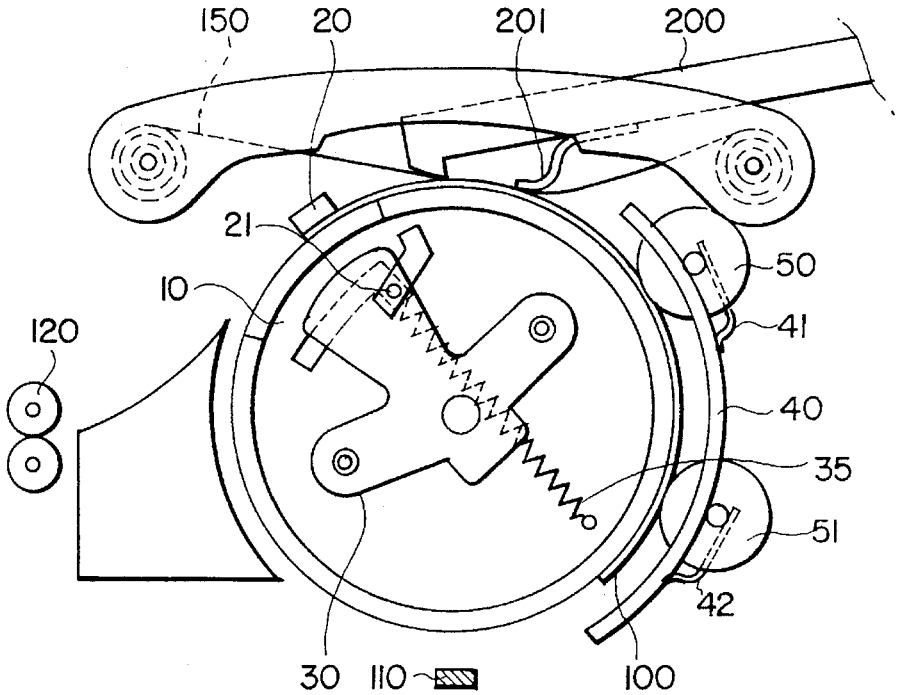

Referring to FIG. 16, if drum 10 is driven in accordance with the sensing signal of sensor 110 so that the leading edge of the printing paper 100 is transferred to the initial printing position D (FIG. 12) while unclamped, the rotation of drum 10 is stopped. Also, the front of any color ribbon (yellow, magenta or cyan) stops at the initial printing position, with ink ribbon being wound in accordance with the printing signal. Print head 200 is moved down by a driving element (not shown), to apply pressure to the front of the printing paper 100. When print head 200 is moved down to apply pressure to the leading edge of the printing paper, as shown in FIG. 16, plate spring 201 elastically applies pressure to the printing paper 100 at the position which is just in front of the initial printing position. Therefore, the separating tendency of the printing paper 100, which is caused by the pressure applied by print head 200 and the rotation force of drum 10, can be prevented.

As described above, the printing method and apparatus according to the present invention have an advantage in that the printed image paper has no non-image portion in the leading and trailing edge margins of the paper. Also, the separating phenomenon of the printing paper which is caused by the pressure applied by the printing head and the rotation force of the drum can be prevented by the use of a plate spring, or the like, for elastically applying pressure to the printing paper at the position just in front of the initial printing position when the print head is moved down, so that the printing paper is stably supplied to obtain a good quality printed image.

The preferred embodiments can be controlled by known controllers and actuating devices. For example, a microprocessor based device can be programmed to actuate solenoids, motors, and the like, to achieve the operation described above.

While the invention has been described through preferred embodiments, various modifications can be made without departing from the scope of the invention as defined by the appended claims.

What is claimed is:

1. A printing method in which printing medium is supplied to a rotating drum, transferred while being clamped to the rotating drum while a print head prints an image on the printing medium said method comprising the steps of:

clamping the printing medium to the drum while the drum is at a first position;

releasing the printing medium at a second position just in front of an initial printing position wherein the print head prints on the printing medium;

transferring a leading edge of the printing medium to the initial printing position so that printing starts at the leading edge of the printing medium;

subsequently clamping the printing medium at the third position located beyond the initial printing position.

2. A printing method according to claim 1, wherein said clamping and releasing steps are accomplished by controlling a clamp.

3. A printing method according to claim 2, further comprising the step of:

pressing the printing medium toward the drum at the position just in front of the initial printing position as the print head is moved toward the drum in order to apply pressure to the leading edge of the printing medium.

4. A printing apparatus having a rotating drum to which a printing medium is supplied, and a clamp for clamping the printing medium to the drum and rotating with the drum, so that a print head prints an image on the printing paper, comprising:

control means for rotating the drum;

clamp control means for controlling the clamp such that the printing medium is clamped at a first position and released at a second position just in front of an initial printing position, and the front of the printing medium is transferred by the drum to the initial printing position so that printing starts at the leading edge of the printing medium, and the printing medium is again clamped at a third position located beyond the initial printing position.

5. A printing apparatus according to claim 4, wherein both ends of said clamp are coupled to an axis of the drum, said clamp being slidable forward and away from said drum, linkage pins are formed on both sides of the clamp, respectively, openings are formed on both sides of the drum, said clamp extending through said openings to regulate rotating of said clamp with respect to said drum, said clamp control means comprising:

a flange coupled to both sides of the drum and having a first cam hole for guiding the linkage pins;

a lift having a second cam hole, wherein the second cam hole is coupled to the linkage pin and the lift is coupled to the axis of the drum; and operating means for operating the lift such that the linkage pin slides in the first and second cam holes, wherein the clamp clamps the printing medium at the second position, and the lift is operated by the operating means to allow the printing medium to be transferred to the third position in an unclamped state.

6. A printing apparatus according to claim 5, wherein said operating means comprises:

a frame for supporting the drum;

a cam;

a driving source for driving said cam;

a slider provided on said frame in a slidable manner;

a linkage lever having one end coupled to the slider and the other end coupled to said cam driving source for operating the slider; and an operating lever having one end coupled to the slider by means of a spring, said operating lever being supported on the frame in a rotatable manner, wherein said operating lever rotates in response to movement of the slider.

7. A printing apparatus according to claim 4, further comprising a guide roller elastically biased into contact with the drum at the second position, the printing medium being transferred between said drum and said guide roller when the printing medium in an is unclamped state at the second position.

8. A printing apparatus according to claim 5, wherein said linkage pin is connected to the flange by means of a spring, so that the clamp returns a clamped state while the printing medium is at the third position due to force of said spring.

9. A printing apparatus according to claim 4, wherein a sensor for sensing the supply of the printing medium is provided on one side of the drum proximate the first position, the drum is controlled and driven by said control means to rotate in accordance with the sensing state of the sensor, so that the leading edge of the printing medium is transferred to the initial printing position.

10. A printing apparatus according to claim 4, further comprising printing medium pressing means for pressing the printing medium toward the drum just in front of the initial printing position, when the print head is moved toward the drum in order to apply pressure to the leading edge of the printing medium.

11. A printing apparatus according to claim 10, wherein said printing paper pressing means comprises a plate spring provided on the print head, so that the print head applies pressure to the printing medium and the plate spring applies elastic pressure to the printing medium as the printing medium is transferred to the initial printing position while in contact with the drum.

* * * * *